US010818253B2

(12) United States Patent
Park et al.

(10) Patent No.: US 10,818,253 B2
(45) Date of Patent: Oct. 27, 2020

(54) DISPLAY DEVICE AND METHOD OF DRIVING THE SAME

(71) Applicant: LG Display Co., Ltd., Seoul (KR)

(72) Inventors: Nojin Park, Gyeonggi-do (KR); Jeonga Lee, Seoul (KR); Jiwoong Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/251,480

(22) Filed: Aug. 30, 2016

(65) Prior Publication Data

US 2017/0061860 A1 Mar. 2, 2017

(30) Foreign Application Priority Data

Aug. 31, 2015 (KR) ..... 10-2015-0123256

(51) Int. Cl.
*G09G 3/36* (2006.01)
*G09G 3/20* (2006.01)

(52) U.S. Cl.
CPC ..... *G09G 3/3648* (2013.01); *G09G 2310/061* (2013.01); *G09G 2310/08* (2013.01); *G09G 2320/0233* (2013.01); *G09G 2320/041* (2013.01); *G09G 2320/064* (2013.01); *G09G 2330/023* (2013.01)

(58) Field of Classification Search
CPC ..... G09G 3/3648; G09G 2330/023
See application file for complete search history.

(56) References Cited

U.S. PATENT DOCUMENTS 5,262,766 A * 11/1993 Sakamoto ..... G09G 3/30 345/691
6,485,306 B1 * 11/2002 Yeh ..... G03F 7/2022 382/312
2001/0022583 A1 * 9/2001 Jiang ..... G09G 1/165 345/211
2002/0060673 A1 * 5/2002 Noritake ..... G09G 3/3611 345/204
2003/0030607 A1 * 2/2003 Kitagawa ..... G09G 3/2092 345/87
2004/0228265 A1 * 11/2004 Ota ..... G09G 3/20 369/292
2005/0017965 A1 * 1/2005 Morita ..... G06F 1/263 345/211
2005/0073490 A1 * 4/2005 Kojima ..... G09G 3/3611 345/87
2005/0231453 A1 * 10/2005 Park ..... G09G 3/3611 345/87
2005/0286010 A1 * 12/2005 Park ..... G02F 1/133382 349/199

(Continued)

*Primary Examiner* — Nitin Patel
*Assistant Examiner* — Robert M Stone
(74) *Attorney, Agent, or Firm* — Morgan, Lewis & Bockius LLP

(57) ABSTRACT

A display device comprises a display panel, a drive circuit configured to drive the display panel, a timing controller configured to control the drive circuit, and a power supply configured to output a supply voltage to the display panel. The timing controller is configured to output a vertical synchronization signal having an image display period and a blanking interval. The power supply is configured to vary a level of the supply voltage during the blanking interval of the vertical synchronization signal.

22 Claims, 7 Drawing Sheets

(56) References Cited

U.S. PATENT DOCUMENTS

2007/0176882 A1* 8/2007 Araki ..... G09G 3/3648 345/101
2008/0049005 A1* 2/2008 Okita ..... G09G 3/3648 345/207
2008/0111773 A1* 5/2008 Tsuge ..... G09G 3/3241 345/76
2008/0224765 A1* 9/2008 Klein ..... H03K 5/125 329/312
2011/0187693 A1* 8/2011 Chung ..... G09G 5/00 345/211
2012/0133635 A1* 5/2012 Ji ..... G09G 3/3688 345/212
2013/0082910 A1* 4/2013 Lee ..... G09G 3/3208 345/76
2015/0138254 A1* 5/2015 Nakayama ..... G09G 3/3688 345/690
2015/0243214 A1* 8/2015 Jeong ..... G09G 3/3233 345/214
2015/0262529 A1* 9/2015 Lee ..... G09G 3/3233 345/76
2015/0294612 A1* 10/2015 Kim ..... G09G 3/3225 345/690
2016/0086540 A1* 3/2016 Kim ..... G09G 3/3233 345/214
2016/0098951 A1* 4/2016 Kim ..... G09G 3/3688 345/209
2016/0111042 A1* 4/2016 Pyeon ..... G09G 3/3208 345/212
2016/0111055 A1* 4/2016 Na ..... G09G 3/3666 345/212
2016/0125832 A1* 5/2016 Hwang ..... G09G 3/3696 345/212
2017/0061860 A1* 3/2017 Park ..... G09G 3/3648
2017/0098409 A1* 4/2017 Heo ..... G09G 3/2092

* cited by examiner

DISPLAY DEVICE AND METHOD OF DRIVING THE SAME

This application claims the benefit of Korean Patent Application No. 10-2015-0123256, filed on Aug. 31, 2015, which is hereby incorporated by reference for all purposes as if fully set forth herein.

BACKGROUND

Field of the Invention

The present disclosure relates to a display device and a method of driving the same.

Discussion of the Related Art

With the development of information technology, the market for displays to connect media between users and information is growing. In line with this trend, display devices, such as a liquid crystal display (LCD), an organic light emitting display (OLED), an electrophoretic display (EPD), and a plasma display panel (PDP), are increasingly used.

Some of the above-mentioned display devices, e.g., the liquid crystal display or the organic light-emitting display, comprise a display panel comprising a plurality of subpixels arranged in a matrix, and a drive part that drives the display panel. The drive part comprises a scan driver that supplies a scan signal (or gate signal) to the display panel and a data driver that supplies a data signal to the display panel. Such a display device displays a particular image as the display panel emits or passes light through based on the power output from a power supply unit, the scan signal output from the scan driver, and the data signal output from the data driver.

Related art display devices vary the level of voltage in order to compensate for fluctuations in power output from a power supply unit according to temperature or other environmental conditions. Examples include optical compensation and pattern compensation, among others. However, the related art method of voltage level variation has a problem in that, when the voltage level is varied, the change in voltage level may be perceived as block dimming on the screen, that is, the screen dims in blocks.

SUMMARY OF THE INVENTION

Accordingly, the present invention is directed to a display device and a method of driving the same that substantially obviate one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device comprises: a display panel; a drive circuit configured to drive the display panel; a timing controller configured to control the drive circuit; and a power supply configured to output a supply voltage to the display panel, wherein the power supply is configured to vary a level of the supply voltage during a blanking interval in which no image is displayed on the display panel.

In another aspect, a method of driving a display device having a display panel and a power supply comprises: supplying a scan signal and a data signal to the display panel; supplying a supply voltage from the power supply to the display panel; and varying a level of the supply voltage only during a blanking interval in which no image is displayed on the display panel.

In yet another aspect, a display device comprises: a display panel; a drive circuit configured to drive the display panel; a timing controller configured to control the drive circuit, the timing controller being configured to output a vertical synchronization signal having an image display period and a blanking interval; and a power supply configured to output a supply voltage to the display panel, the power supply being configured to vary a level of the supply voltage during the blanking interval of the vertical synchronization signal.

It is to be understood that both the foregoing general description and the following detailed description are exemplary and explanatory and are intended to provide further explanation of the invention as claimed.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF EXAMPLE EMBODIMENTS

Reference will now be made in detail to embodiments of the invention, examples of which are illustrated in the accompanying drawings. Specific example embodiments of the present invention will be described in detail with reference to the attached drawings.

A display device according to the present invention may be implemented as or in, among others, a television, a set-top box, a navigation system, a video player, a Blu-ray player, a personal computer (PC), a home theater, a wearable device, or a smartphone (mobile phone). The display panel of the display device may be, but is not limited to, a liquid crystal panel, an organic light-emitting display panel, an electrophoretic display panel, or a plasma display panel. For convenience of explanation, an organic light-emitting display will be described below by way of example.

Figure 1:
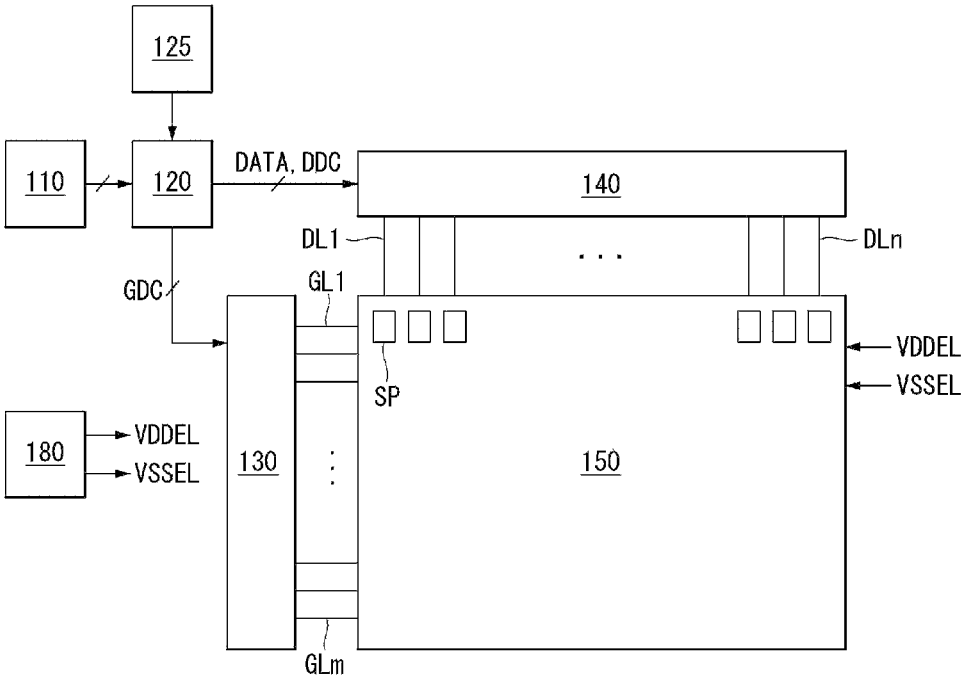
FIG. 1 is a block diagram schematically showing an organic light emitting display.
Figure 2:
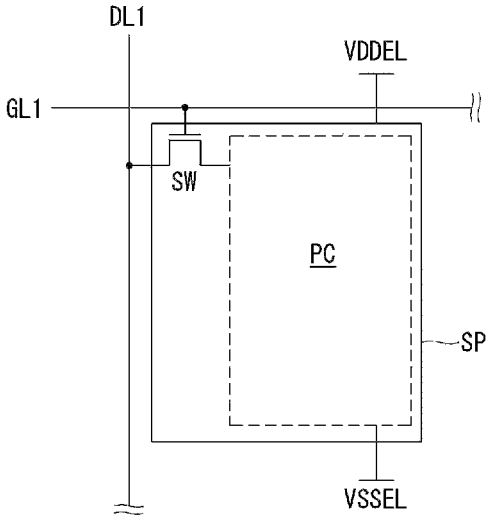
FIG. 2 is a view schematically showing an example configuration of a subpixel of FIG. 1.
Figure 3:
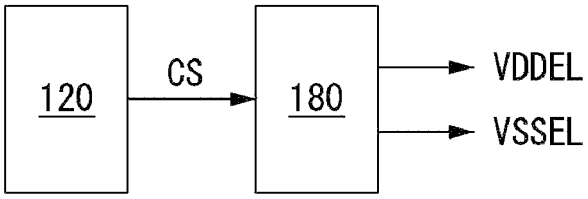
FIG. 3 is a block diagram for explaining a driving system for a power supply.

FIG. 1 is a block diagram schematically showing an organic light emitting display. FIG. 2 is a view schematically showing an example configuration of a subpixel of FIG. 1. FIG. 3 is a block diagram for explaining a driving system for a power supply.

As illustrated in FIG. 1, an organic light-emitting display may comprise an image supply circuit 110, a timing controller 120, a sensor circuit 125, a scan driver 130, a data driver 140, a display panel 150, and a power supply 180.

The display panel 150 displays an image in response to a scan signal and data signal DATA that are output from a drive circuit comprising the scan driver 130 and the data driver 140. The display panel 150 may be a top-emission display panel, a bottom-emission display panel, or a dual-emission display panel. The display panel 150 may be flat, curved, or flexible depending on the material of a substrate. In the display panel 150, subpixels SP may emit light themselves in response to a drive current.

As illustrated in FIG. 2, a subpixel may comprise a switching transistor SW connected to a scan line GL1 and a data line DL1 (or formed at the intersection), and a pixel circuit PC that operates in response to a data signal DATA supplied through the switching transistor SW. The pixel circuit PC may comprise such circuit components as a driving transistor (not shown), a storage capacitor (not shown), and an organic light-emitting diode (not shown), and a compensation circuit (not shown) for them.

In the subpixel, when the driving transistor turns on in response to a data voltage stored in the storage capacitor, a drive current is supplied to the organic light-emitting diode located between a first power line VDDEL and a second power line VSSEL. The organic light-emitting diode emits light in response to the drive current.

The compensation circuit may be a circuit for compensating the threshold voltage of the driving transistor. The compensation circuit may include, among others, one or more thin-film transistors and a capacitor. The compensation circuit may have a wide variety of known configurations depending on the compensation method, so a detailed illustration and description of this will be omitted. The thin-film transistors may be implemented based on a low-temperature polysilicon (LTPS), amorphous silicon (a-Si), oxide, or organic semiconductor layer.

The image supply circuit 110 may process a data signal into an image, and output it together with other signals, such as a vertical synchronization signal, horizontal synchronization signal, data enable signal, and clock signal. The image supply circuit 110 may supply such signals as the vertical synchronization signal, horizontal synchronization signal, data enable signal, clock signal, among others, to the timing controller 120.

The timing controller 120 may receive the data signal and other signals output from the image supply circuit 110, and output a gate timing control signal GDC for controlling the operation timing of the scan driver 130 and a data timing control signal DDC for controlling the operation timing of the data driver 140. The timing controller 120 may supply the data signal DATA, together with the data timing control signal DDC, to the data driver 140.

The sensor circuit 125 serves to sense environmental conditions (e.g., temperature) of the interior, the exterior, or both and to provide sensing data to the timing controller 120. For instance, the sensor circuit 125 may sense temperature and output temperature sensing data so that the timing controller 120 performs compensation operation on a particular device in response to temperature changes.

The scan driver 130 may output a scan signal, in response to the gate timing control signal GDC supplied from the timing controller 120. The scan driver 130 may comprise a level shifter and a shift register. The scan driver 130 may supply the scan signal to the subpixels SP included in the display panel 150 through scan lines GL1 to GLm, where m is a positive integer. The scan driver 130 may be formed on the display panel 150 in the form of a gate-in-panel or an integrated circuit (IC). In the scan driver 130, the portion formed by the gate-in-panel technology may be a shift register.

The data driver 140 may sample and latch the data signal DATA in response to the data timing control signal DDC supplied from the timing controller 120. Then, the data driver may convert an analog data signal into a digital data signal and output it, in response to a gamma reference voltage. The data driver 140 may supply the data signal DATA to the subpixels SP included in the display panel 150 through data lines DL1 to DLn. The data driver 140 may be formed in the form of an integrated circuit (IC).

The power supply 180 may generate a first supply voltage VDDEL and a second supply voltage VSSEL to be supplied to the display panel 150. The first supply voltage VDDEL corresponds to a high level voltage, and the second supply voltage VSSEL corresponds to a low level voltage. The power supply 180 may generate power to be supplied to the scan driver 130 or data driver 140, as well as the first supply voltage VDDEL and the second supply voltage VSSEL to be supplied to the display panel 150, based on input power supplied from an external source.

As illustrated in FIG. 3, the power supply 180 may generate and vary output voltages in response to a power control signal CS output from the timing controller 120. A counter value for the power control signal CS output from the timing controller 120 may be either logic high or logic low.

The power supply 180 may include a register that is set to an output power corresponding to the counter value. Thus, the power supply 180 may perform a variation operation for increasing or decreasing the level of the first supply voltage VDDEL in response to the counter value of the power control signal CS output from the timing controller 120.

The above-described display device may display a particular image as the display panel emits or transmits light through based on the first and second supply voltages VDDEL and VSSEL output from the power supply 180, and on the scan signal and data signal respectively output from the scan driver 130 and data driver 140. Also, the above-described display device may vary the level of the first supply voltage VDDEL, for example, to compensate for, among other things, temperature changes around the device, to perform optical compensation, or to pattern compensation.

However, the above method of variation proposed may lead to a problem in that, when the level of the first supply voltage VDDEL is varied, the change in voltage level may be perceived as block dimming on the screen, that is, the screen dims in blocks.

Example embodiments of the present invention are described below in more detail in comparison with a test example.

Test Example

Figure 4:
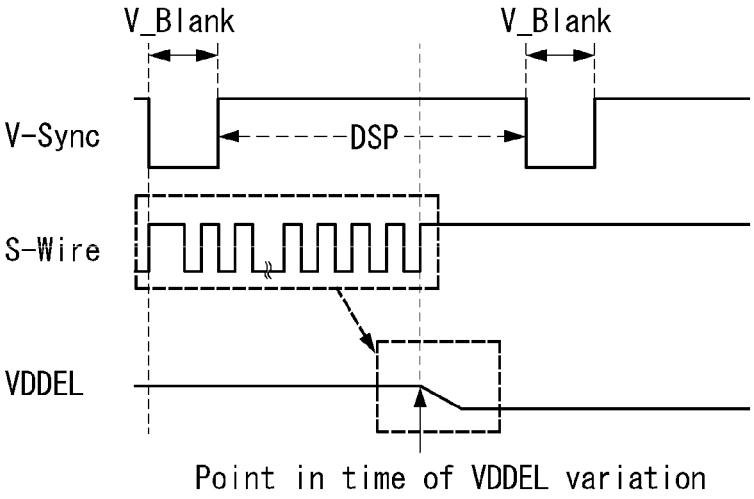
FIG. 4 is a waveform diagram showing a method of varying the level of a first supply voltage in a display device according to a test example.
Figure 5:
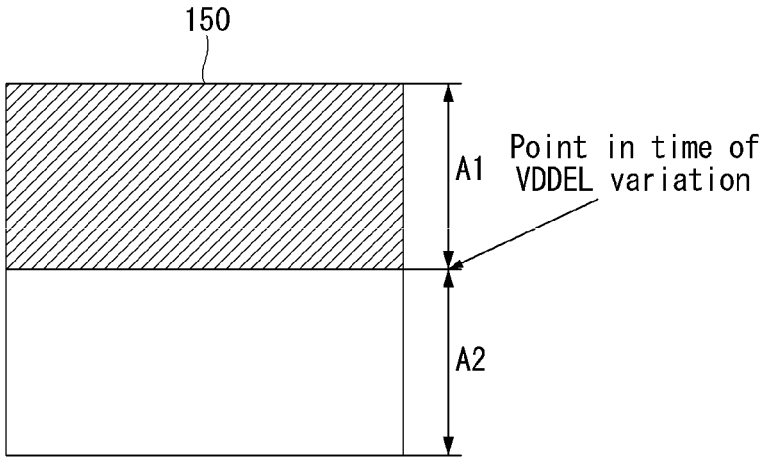
FIG. 5 is a diagram for explaining problems in the test example.

FIG. 4 is a waveform diagram showing a method of varying first power in a display device according to a test example. FIG. 5 is a diagram illustrating potential problems in the test example.

As illustrated in FIG. 4, a display device according to the test example varies the level of the first supply voltage VDDEL output from the power supply according to the Single Wire Protocol (abbreviated as S-Wire). Hence, the S-Wire denotes the waveform of a signal supplied to the power supply 180, which is a power control signal CS output from the timing controller 120. The Single-Wire Protocol is a protocol for changing or varying the characteristics (e.g., a logic state) of pulses in a signal, to control a particular device by signals provided through a single signal wire.

In the method according to the test example, however, voltage regulation is done as soon as a power control signal is input into the power supply. That is, the power supply varies the level of the first supply voltage VDDEL it is to output, upon receipt of all counter values for the power control signal.

The timing controller supplies a power control signal each time voltage variation is needed, for example, due to the operation of the sensor circuit, regardless of whether the display panel is an image display period (DSP) in which the display panel displays an image or a vertical blanking interval (V_Blank) in which the display panel displays no image. The image display period (DSP) is the remaining period of time other than the blanking interval V_Blank of the vertical synchronization signal V-Sync.

In the method according to the test example, when the level of the first supply voltage VDDEL is varied during the image display period DSP, the change in voltage level may be perceived as block dimming on the screen. As shown in FIG. 5, the block dimming means that the change in voltage level is seen in blocks at a point in time when the level of the first supply voltage VDDEL is varied, as shown in the area A1 and area A2 of the display panel 150.

As can be seen from the test example, it was determined that the block dimming occurred because the output voltage of the power supply was regulated during the image display period DSP for the display panel. To solve this problem, the present invention allows the level of the first supply voltage VDDEL to be varied only during the blanking interval V_Blank so that no block dimming is seen during the actual image display period.

A method of varying the level of the first supply voltage VDDEL only during the blanking interval V_Blank may be as follows. The higher the resolution of the display device, the shorter the blanking interval V_Blank. Also, there is an amount of time physically needed for the power supply 180 to vary an output voltage level. Therefore, the following example embodiments should be selected and applied appropriately based on the resolution of the display device.

First Example Embodiment

Figure 6:
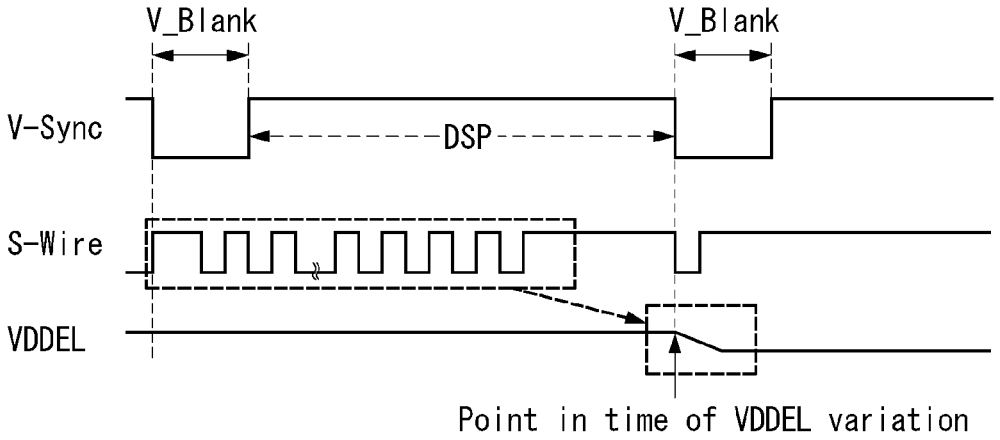
FIG. 6 is a waveform diagram showing a method of varying the level of a first supply voltage in a display device according to a first example embodiment of the present invention.

FIG. 6 is a waveform diagram showing a method of varying the level of a first supply voltage in a display device according to a first example embodiment of the present invention.

As illustrated in FIGS. 1, 3, and 6, a display device according to the first example embodiment of the present invention varies the level of the first supply voltage VDDEL output from the power supply 180 according to the Single Wire Protocol (abbreviated as S-Wire). The S-Wire denotes the waveform of a signal supplied to the power supply 180, which may be a power control signal CS output from the timing controller 120.

In the first example embodiment of the present invention, the power supply unit 180 varies the level of the first supply voltage VDDEL only during the blanking interval V_Blank, regardless of when a power control signal CS is received, during the blanking interval V_Blank or the image display period DSP, or during both of the blanking interval V_Blank and the image display period DSP.

For example, upon receiving a counter value for the power control signal CS through a single wire, the power supply 180 may select the internal register and vary the level of the first supply voltage VDDEL in synchronization with the start (the falling edge from the logic high to the logic low) of the next or upcoming blanking interval V_Blank. To this end, the power supply 180 may receive the power control signal CS and a vertical synchronization signal V-Sync from the timing controller 120.

In a driving method according to the first example embodiment of the present invention, the first supply voltage VDDEL may be varied in such a way that its level rises or falls in synchronization with the start of the blanking interval V_Blank. In this case, the variation of the level of the first supply voltage VDDEL is completed before the end (the rising edge from the logic low to the logic high) of the blanking interval V_Blank.

With the driving method according to the first example embodiment of the present invention, the voltage transition time (or the voltage variation time) of the first supply voltage VDDEL may end within the blanking interval V_Blank. Accordingly, the power supply 180 has sufficient time to perform a switching operation for varying the output supply voltage. This allows for a sufficient margin for voltage variation. For the display panel 150, the first supply voltage VDDEL is not varied during the image display period DSP, thereby improving the display quality without potential issues like block dimming.

Second Example Embodiment

Figure 7:
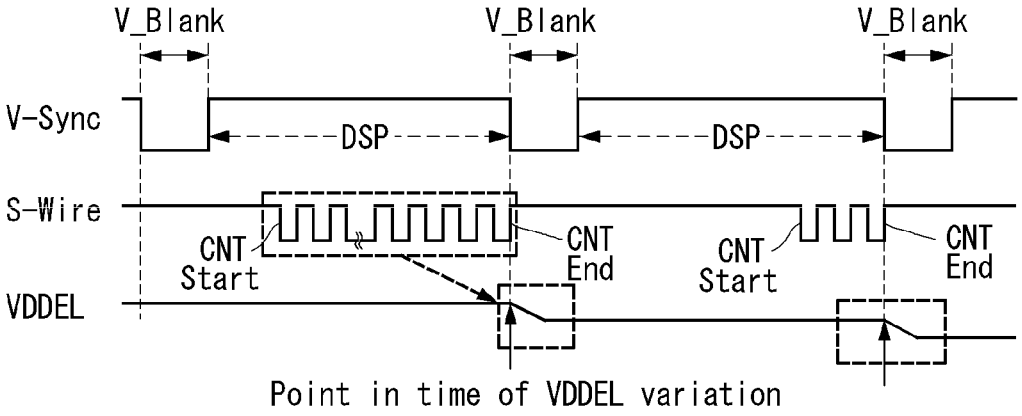
FIG. 7 is a waveform diagram showing a method of varying the level of a first supply voltage in a display device according to a second example embodiment of the present invention.

FIG. 7 is a waveform diagram showing a method of varying the level of a first supply voltage in a display device according to a second example embodiment of the present invention.

As illustrated in FIGS. 1, 3, and 7, a display device according to the second example embodiment of the present invention varies the level of the first supply voltage VDDEL output from the power supply 180 according to the Single Wire Protocol (abbreviated as S-Wire). The S-Wire denotes the waveform of a signal supplied to the power supply 180, which may be a power control signal CS output from the timing controller 120.

In the second example embodiment of the present invention, the start time CNT Start and the end time CNT End of the transmission of the power control signal CS output from the timing controller 120 may be adjusted so that the power supply 180 varies the level of the first supply voltage VDDEL only during the blanking interval V_Blank.

For example, the timing controller 120 adjusts the start time CNT Start and the end time CNT End of the transmission of the power control signal CS according to the counter value of the power control signal CS (the number in the counter) in such a way that the end time CNT End of the transmission is synchronized with the start (the falling edge from the logic high to the logic low) of the blanking interval V_Blank—that is, in such a way that all the counter values for the power control signal are transmitted before the start of the blanking interval. In this case, the power supply 180 receives only the power control signal CS.

The power supply 180 may increase or decrease the level of the first supply voltage VDDEL based on the counter value of the power control signal CS (the number in the counter). That is, the counter value of the power control signal CS (the number in the counter) may serve as a factor for determining the amount of variation in the first supply voltage VDDEL. The timing controller 120 may vary the start time CNT Start of the transmission of the power control signal CS based on the amount of variation in the first supply voltage VDDEL in such a way that the end time CNT End of the transmission of the power control signal CS is synchronized with the start (e.g., a falling edge from the logic high to the logic low) of the blanking interval V_Blank.

In a driving method according to the second example embodiment of the present invention, the level of the first supply voltage VDDEL is varied in such a way that it rises or falls in synchronization with the start of the blanking interval V_Blank. In this case, the variation in the level of the first supply voltage VDDEL is completed before the end (e.g., a rising edge from the logic low to the logic high) of the blanking interval V_Blank.

With the driving method according to the second example embodiment of the present invention, the transition time of the first supply voltage VDDEL may end within the blanking interval V_Blank. Also, the power supply 180 needs to be supplied with only the power control signal CS, and hence its circuit design does not need to be complex. For the display panel 150, the first supply voltage VDDEL is not varied during the image display period DSP. Accordingly, the display quality may be improved without a block dimming problem, even with a sudden change in the level of a supply voltage.

Third Example Embodiment

Figure 8:
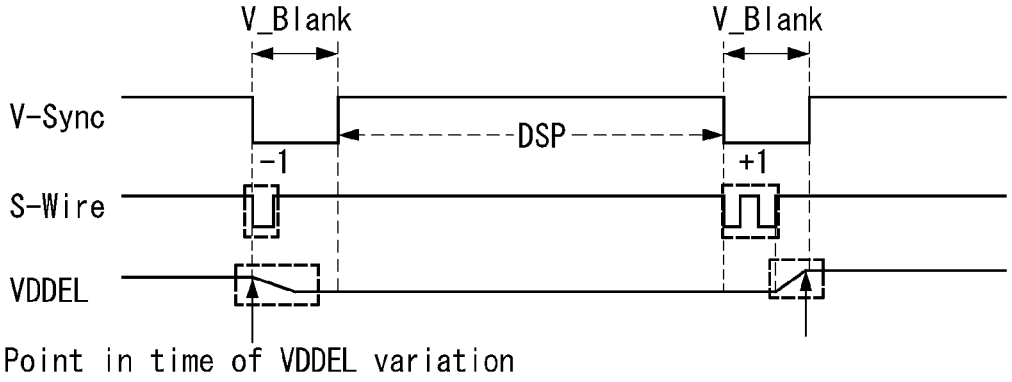
FIG. 8 is a waveform diagram showing a method of varying the level of a first supply voltage in a display device according to a third example embodiment of the present invention.

FIG. 8 is a waveform diagram showing a method of varying the level of the first supply voltage in a display device according to a third example embodiment of the present invention.

As illustrated in FIGS. 1, 3, and 8, a display device according to the third example embodiment of the present invention varies the level of the first supply voltage VDDEL output from the power supply 180 according to the Single Wire Protocol (abbreviated as S-Wire). The S-Wire denotes the waveform of a signal supplied to the power supply 180, which may be a power control signal CS output from the timing controller 120.

In the third example embodiment of the present invention, the start time CNT Start and the end time CNT End of the transmission of the power control signal CS output from the timing controller 120 may be adjusted to be within the blanking interval V_Blank so that the power supply 180 varies the level of the first supply voltage VDDEL only during the blanking interval V_Blank.

For instance, the timing controller 120 may transmit either a "+1 (a logic high pulse)" or "−1 (a logic low pulse)" during the blanking interval V_Blank to minimize the counter value of the power control signal CS (the number in the counter) so that the level of the first supply voltage VDDEL is varied only during the blanking interval V_Blank.

The power control signal CS may have a counter value (the number in the counter) that allows the power control signal CS to be transmitted in synchronization with the start (e.g., a falling edge from the logic high to the logic low) of the blanking interval V_Blank, thereby allowing a variation in the level of the first supply voltage VDDEL to be completed before the end (e.g., a rising edge from the logic low to the logic high) of the blanking interval V_Blank. In this case, the power supply 180 receives the power control signal CS only.

In a driving method according to the third example embodiment of the present invention, the first supply voltage VDDEL is varied in such a way that it rises or falls in synchronization with the start of the blanking interval V_Blank. In this case, the variation of the first supply voltage VDDEL is completed before the end (e.g., a rising edge from the logic low to the logic high) of the blanking interval V_Blank.

With the driving method according to the third example embodiment of the present invention, the voltage transition time of the first supply voltage VDDEL may end within the blanking interval V_Blank. The power supply 180 may need to receive only the power control signal CS, and hence its circuit design does not need to be complex. For the display panel 150, the first supply voltage VDDEL is not varied during the image display period DSP. Thus, the display quality may be improved without a block dimming problem, even with a sudden change in the level of a supply voltage.

Fourth Example Embodiment

Figure 9:
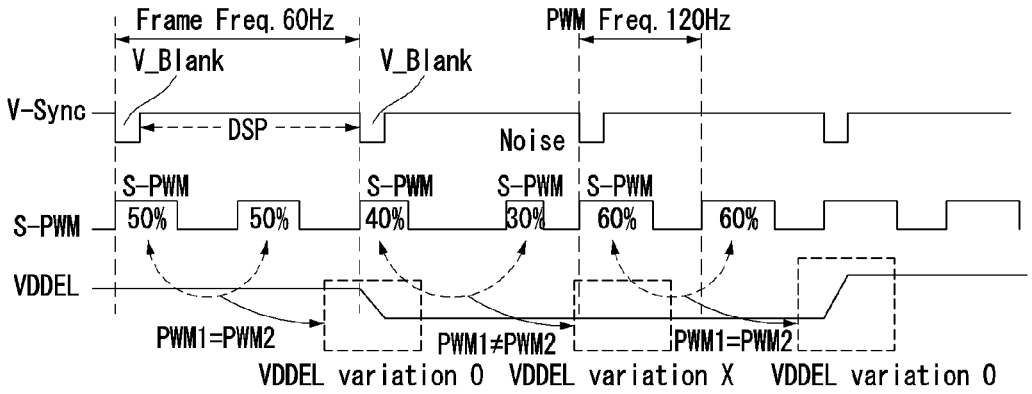
FIG. 9 is a waveform diagram showing a method of varying the level of a first supply voltage in a display device according to a fourth example embodiment of the present invention.
Figure 10:
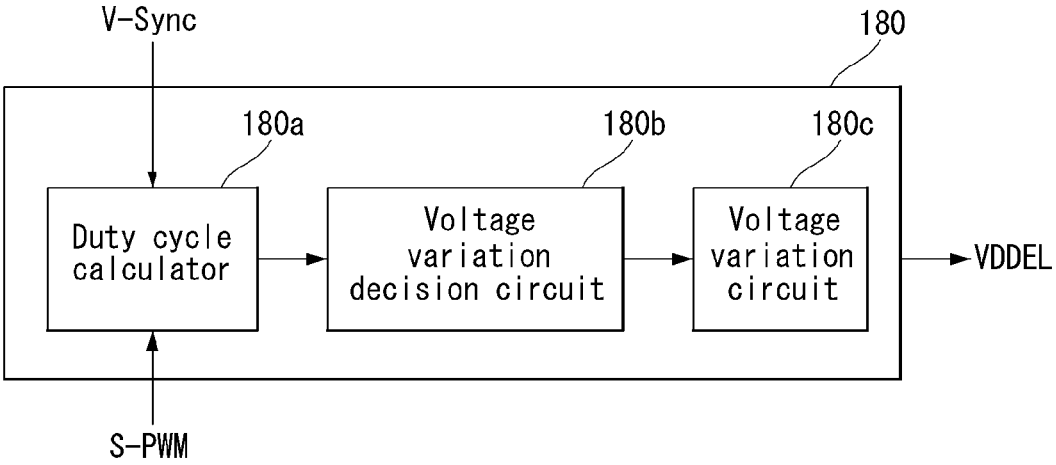
FIG. 10 is a block diagram schematically showing a first power circuit of a power supply according to the fourth example embodiment of the present invention.
Figure 11:
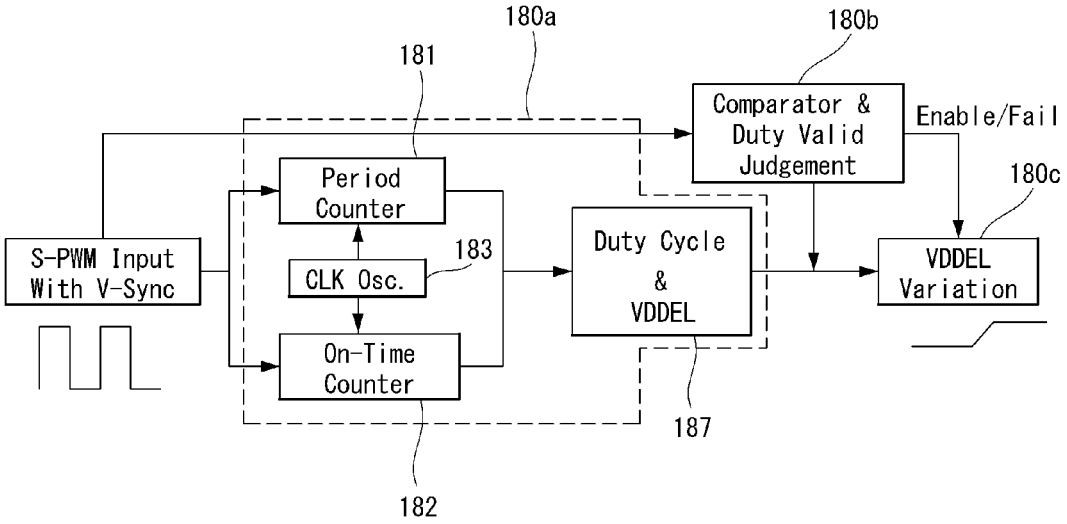
FIG. 11 is a first illustrative drawing showing in detail an example of the first power circuit of the power supply according to the fourth example embodiment of the present invention.
Figure 12:
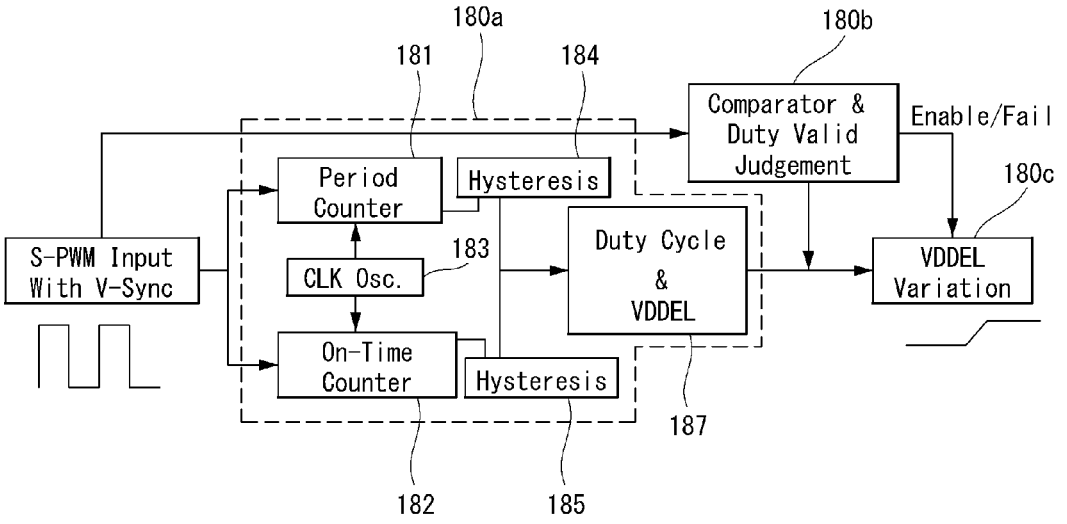
FIG. 12 is a second illustrative drawing showing in detail another example of the first power circuit of the power supply according to the fourth example embodiment of the present invention.

FIG. 9 is a waveform diagram showing a method of varying the level of the first supply voltage in a display device according to a fourth example embodiment of the present invention. FIG. 10 is a block diagram schematically showing an example of a first power circuit of the power supply 180 according to the fourth example embodiment of the present invention. FIG. 11 is a first illustrative drawing showing in detail an example of the first power circuit of the power supply according to the fourth example embodiment of the present invention. FIG. 12 is a second illustrative drawing showing in detail another example of the first power circuit of the power supply according to the fourth example embodiment of the present invention.

As illustrated in FIGS. 1, 3, and 9, a display device according to the fourth example embodiment of the present invention may vary the level of the first supply voltage VDDEL output from the power supply 180 according to pulse-width modulation (abbreviated as S-PWM). The S-PWM denotes the waveform of a signal supplied to the power supply 180, which may be a power control signal CS output from the timing controller 120.

In the fourth example embodiment of the present invention, the duty cycle of a pulse-width modulation signal, e.g., the power control signal CS output from the timing controller 120, may be varied during a frame period so that the power supply 180 varies the level of the first supply voltage VDDEL only during the blanking interval V_Blank. The power supply 180 may increases or decreases the level of the first supply voltage VDDEL based on a change in the duty cycle of the pulse-width modulation signal S-PWM or based on the percentage (%) of on (or active high) time.

The timing controller 120 may vary the duty cycle of the pulse-width modulation signal S-PWM, e.g., the power control signal CS, at least two times during one frame period, to allow the variation in the level of the first supply voltage VDDEL to be completed within the blanking interval V_Blank. One frame period may be a period consisting of one image display interval DSP and one blanking interval V_Blank.

Once the duty cycle of the pulse-width modulation signal S-PWM, e.g., the power control signal CS, is varied, the power supply 180 may compare the duty cycle PWM1 of a first pulse-width modulation signal, which is the previous (N−1)-th pulse-width signal, and the duty cycle PWM2 of a second pulse-width modulation signal, which is the current N-th pulse-width signal.

However, an unexpected noise may occur during the frame period. In this case, the duty cycle of the pulse-width modulation signal S-PWM, e.g., the power control signal CS, may be affected by a problem like noise (Noise S-PWM). Accordingly, the power supply 180 may compare the duty cycles of the previous and current pulse-width modulation signals, and judge whether the modulation has been performed properly by the timing controller 120 or improperly, e.g., due to noise, based on the comparison result.

Examples of proper modulation and improper modulation will be described below. FIG. 9 illustrates an example in which a typical display panel has a frame frequency of 60 Hz and the pulse-width modulation signal has a pulse-width modulation frequency of 120 Hz to generate two signals with the same duty cycle, but the present invention is not limited to this example.

(Normal Modulation)

The power supply 180 compares the duty cycle (e.g., PWM1=50%) of the previous, first pulse-width modulation signal and the duty cycle (e.g., PWM2=50%) of the current, second pulse-width modulation signal with one frame. If the comparison result is that the duty cycle (PWM1=50%) of the previous, first pulse-width modulation signal and the duty cycle (PWM2=50%) of the current, second pulse-width modulation signal are equal, then the power supply unit 180 varies the level of the first supply voltage VDDEL during the blanking interval V_Blank.

That is, both PWM1 and PWM2 have a 50% duty cycle, meaning that the modulation has been performed properly by the timing controller 120. Therefore, the power supply 180 may judge the duty-cycle modulation to be proper. Based on this result, the power supply 180 may vary the level of the first supply voltage VDDEL during the blanking interval V_Blank.

(Abnormal Modulation)

The power supply 180 compares the duty cycle (e.g., PWM1=40%) of the previous, first pulse-width modulation signal and the duty cycle (e.g., PWM2=30%) of the current, second pulse-width modulation signal within one frame. If the comparison result is that the duty cycle (PWM1=40%) of the previous, first pulse-width modulation signal and the duty cycle (PWM2=30%) of the current, second pulse-width modulation signal are not equal, then the power supply 180 does not vary the level of the first supply voltage VDDEL during the blanking interval V_Blank.

That is, if PWM1 has a duty cycle (e.g., 40%) different from a duty cycle (e.g., 30%) of PWM2, and it indicates that the modulation has been performed improperly by the timing controller 120, e.g., due to noise (Noise S-PWM). Therefore, the power supply 180 may judge the duty-cycle modulation to be improper, and, based on this result, may leave the level of the first supply voltage VDDEL unchanged during the blanking interval V_Blank.

In a driving method according to the fourth example embodiment of the present invention, the level of the first supply voltage VDDEL may be varied in such a way that it rises or falls in synchronization with the start of the blanking interval V_Blank. In this case, the variation in the level of the first supply voltage VDDEL may be completed before the end (e.g., a rising edge from the logic low to the logic high) of the blanking interval V_Blank.

With the driving method according to the fourth example embodiment of the present invention, the transition time of the first supply voltage VDDEL may end within the blanking interval V_Blank. The power supply 180 may need to be supplied with only the power control signal CS, and hence its circuit design does not need to be complex. For the display panel 150, the first supply voltage VDDEL is not varied during the image display period DSP. Thus, the display quality may be improved without a block dimming problem, even with a sudden change in the level of a supply voltage.

Now, the circuit configuration of the power supply 180 will be described in detail with examples.

As illustrated in FIGS. 10 and 11, the power supply 180 according to the fourth example embodiment of the present invention may vary the level of the first supply voltage VDDEL that it outputs, based on a pulse-width modulation signal S-PWM, e.g., a power control signal CS supplied from the timing controller. The power supply 180 may vary the level of the first power supply voltage VDDEL also based on a vertical synchronization signal V-Sync supplied from the timing controller. To this end, the power supply 180 may comprise a duty cycle calculator 180*a*, a voltage variation decision circuit 180*b*, and a voltage variation circuit 180*c*.

The duty cycle calculator 180*a* may calculate the duty cycle of the pulse-width modulation signal S-PWM supplied from the timing controller. The duty cycle calculator 180*a* may calculate the duty cycle by counting the total period of the pulse-width modulation signal S-PWM and the proportion of on time in the total period.

To this end, the duty cycle calculator 180*a* may comprise a first counter (e.g., a period counter decider) 181 that counts the total period of the pulse-width modulation signal S-PWM, a second counter (e.g., an on-time counter decider) 182 that counts the proportion of on time in the total period, and a clock generator 183 that allows the first counter 181 and second counter 182 to run based on an internal clock signal CLK. Further, the duty cycle calculator 180*a* may comprise a data storage circuit 187 that calculates a duty cycle based on values extracted by the first and second counters 181 and, 182 and separately stores the calculated duty cycle, in addition to storing the level of the first supply voltage VDDEL.

The voltage variation decision circuit 180*b* may compare the duty cycle of the previous, first pulse-width modulation signal and the duty cycle of the current, second pulse-width modulation signal, and decide whether to vary the level of the first supply voltage VDDEL based on the comparison result. If the comparison result shows that the voltage variation signals are valid, the voltage variation decision circuit 180*b* outputs an enable signal to enable voltage variation. On the contrary, if the comparison result shows that the voltage variation signals are invalid, the voltage variation decision circuit 180*b* outputs a fail signal.

The voltage variation circuit 180*c* varies the present level of the first supply voltage VDDEL based on the vertical synchronization signal V-Sync supplied from the timing controller, the duty cycle of the pulse-width modulation signal S-PWM, and the previous level of the first supply voltage VDDEL. The voltage variation circuit 180*c* varies the level of the first supply voltage VDDEL during the blanking interval V_Blank only upon receiving, from the voltage variation decision circuit 180*b*, an enable signal, In the foregoing description, the duty cycle calculator 180*a*, the voltage variation decision circuit 180*b*, the voltage variation circuit 180*c*, and the components included in them are described, for example, as discrete components from one another in order to explain the functions of each individual component. However, this is merely an illustrative example, and the present invention is not limited to this particularly example. One or more of these components may be integrated in different configurations.

In addition to the configuration shown in FIGS. 10 and 11, the power supply 180 according to the fourth example embodiment of the present invention may incorporate other alternative configurations. For example, as illustrated in FIGS. 10 and 12, the power supply 180 may have a configuration in which hysteresis detectors 184 and 185 are included within the duty cycle calculator 180*a*.

The hysteresis detectors 184 and 185 may be used to reduce errors that may occur when the first counter 181 and the second counter 182 inaccurately count in a particular environment. The hysteresis detectors 184 and 185 may filter out inaccurate values based on a hysteresis (curves) and update the counter value based on accurate values. Therefore, the hysteresis detectors 184 and 185 may help reduce the error probability when the total period of the pulse-with modulation signal S-PWM and the proportion of on (or active high) time in the total period are counted.

With the driving method according to the fourth example embodiment of the present invention, the voltage transition time of the first supply voltage VDDEL may end within the blanking interval V_Blank. The power supply 180 needs to be supplied with only the power control signal CS, and hence its circuit design does not need to be complex.

For the display panel 150, the first supply voltage VDDEL is not varied during the image display period DSP. Accordingly, display quality may be improved without a drawback like block dimming, even with a sudden change in the supply voltage. Moreover, the voltage variation is based on a result of comparison between two signals. This protects the display panel from being affected by noise by preventing an undesired level of the supply voltage caused by noise to be output.

Figure 13A:
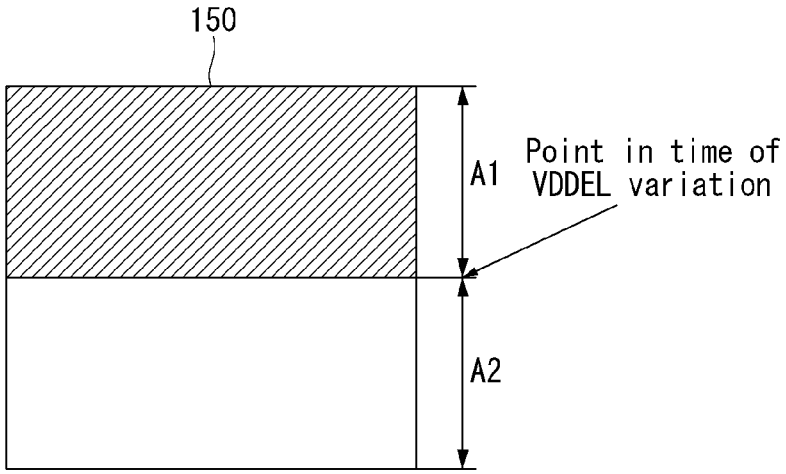
FIGS. 13A and 13B are respective views for comparatively explaining the test example and the example embodiments of the present invention.

FIG. 13 is a view for comparatively explaining the test example and the example embodiments of the present invention. As illustrated in FIG. 13A, in the test example, block dimming, that is, screen dimming in blocks, is seen at a point in time when the first supply voltage VDDEL is varied, as in the area A1 and are A2 of the display panel 150.

Figure 13B:
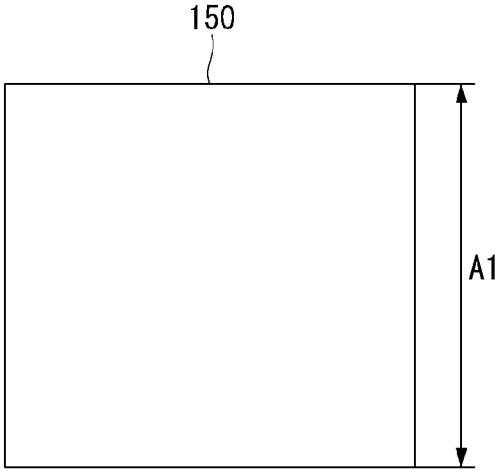

On the other hand, as illustrated in FIG. 13B, in the example embodiments of the present invention, block dimming is not seen during the actual image display period since the first supply voltage VDDEL is varied only during the blanking interval V_Blank.

As discussed above, in the example embodiments of the present invention, the supply voltage is varied during a period in which the display panel displays no image. This prevents a change in the supply voltage level from being perceived as block dimming, that is, screen diming in blocks, at a point in time of the voltage variation.

It will be apparent to those skilled in the art that various modifications and variations can be made in the display device and the method of driving the same of the present invention without departing from the spirit or scope of the inventions. Thus, it is intended that the present invention cover the modifications and variations of this invention provided they come within the scope of the appended claims and their equivalents.

What is claimed is:

1. A display device, comprising:

a display panel;

a drive circuit configured to drive the display panel;

a timing controller configured to control the drive circuit and to generate a power control signal including a counter value; and a power supply configured to output a supply voltage directly to a power line of the display panel based on the counter value of the power control signal received from the timing controller, wherein the power supply is configured to vary a level of the supply voltage during a blanking interval in which no image is displayed on the display panel, and wherein the power supply includes a register set to an output power corresponding to the counter value of the power control signal so that the level of the supply voltage is configured to be varied based on the counter value of the power control signal.

2. The display device of claim 1, wherein the power supply is configured to vary the level of the supply voltage within the blanking interval and to maintain the level of the supply voltage constant within an image display period.

3. The display device of claim 1, wherein the power supply is configured to vary the level of the supply voltage only during the blanking interval in response to the counter value of the power control signal.

4. The display device of claim 1, wherein the power supply is configured to vary the level of the supply voltage in synchronization with a start of the blanking interval, regardless of whether the power control signal is input to the power supply during or outside the blanking interval.

5. The display device of claim 1, wherein the timing controller is configured to control a start of a transmission of the power control signal to the power supply based on an amount of variation in the level of the supply voltage so that an end of the transmission of the power control signal to the power supply is synchronized with a start of the blanking interval.

6. The display device of claim 1, wherein the timing controller is configured to generate the power control signal so that:

a start of a transmission of the power control signal to the power supply is synchronized with a start of the blanking interval, and an end of the transmission of the power control signal to the power supply is within the blanking interval.

7. The display device of claim 1, wherein the timing controller is configured to generate the power control signal to the power supply based on a Single Wire Protocol.

8. The display device of claim 1, wherein the power control signal is a pulse-width modulated power control signal to control the power supply.

9. The display device of claim 8, wherein the timing controller is configured to vary a duty cycle of the pulse-width modulated power control signal at least twice to sequentially generate a first pulse-width modulation signal and a second pulse-width modulation signal during one frame period, and wherein the power supply is configured to vary the level of the supply voltage during the blanking interval only when a duty cycle of the first pulse-width modulation signal and a duty cycle of the second pulse-width modulation signal are substantially equal to each other.

10. The display device of claim 9, wherein the power supply comprises:

a duty cycle calculator configured to calculate the respective duty cycles of the first and the second pulse-width modulation signals;

a voltage variation decision circuit configured to compare the duty cycle of the first pulse-width modulation signal and the duty cycle of the second pulse-width modulation signal, and to output an enable signal if the duty cycle of the first pulse-width modulation signal and the duty cycle of the second pulse-width modulation signal are substantially equal to each other; and a voltage variation circuit configured to vary the level of the supply voltage based on a vertical synchronization signal supplied from the timing controller, the duty cycle of the first or the second pulse-width modulation signal, the enable signal, and a previous level of the supply voltage.

11. The display device of claim 1, further comprising a sensor circuit configured to sense an environmental condition of the display device and to provide a sensing data to the timing controller, wherein the level of the supply voltage is configured to be varied based on the sensing data.

12. The display device of claim 1, wherein the power supply is configured to vary the level of the supply voltage during the blanking interval based on the counter value received during one or both of an image display period directly preceding the blanking interval and another blanking interval directly preceding the image display period, the display panel being configured to display an image during the image display period and to display no image during the blanking interval and the another blanking interval.

13. A display device, comprising:

a display panel;

a drive circuit configured to drive the display panel;

a timing controller configured to control the drive circuit and to generate a power control signal including a counter value, the timing controller being configured to output a vertical synchronization signal having an image display period and a blanking interval; and a power supply configured to output a supply voltage directly to a power line of the display panel, the power supply being configured to vary a level of the supply voltage during the blanking interval of the vertical synchronization signal based on the counter value of the power control signal received from the timing controller and to maintain the level of the supply voltage constant during the image display period, wherein the power supply includes a register set to an output power corresponding to the counter value of the power control signal so that the level of the supply voltage is configured to be varied based on the counter value of the power control signal.

14. The display device of claim 13, wherein the power supply is configured to vary the level of the supply voltage only during the blanking interval in response to the counter value of power control signal.

15. The display device of claim 14, wherein the power supply is configured to vary the level of the supply voltage in synchronization with a start of the blanking interval, regardless of whether the power control signal is input to the power supply during the blanking interval or during the image display period, or during both the blanking interval and the image display period.

16. The display device of claim 14, wherein the timing controller is configured to control a start of a transmission of the power control signal to the power supply based on an amount of variation in the level of the supply voltage so that an end of the transmission of the power control signal to the power supply is synchronized with a start of the blanking interval.

17. The display device of claim 14, wherein the timing controller is configured to generate the power control signal so that:

a start of a transmission of the power control signal to the power supply is synchronized with a start of the blanking interval, and an end of the transmission of the power control signal to the power supply is within the blanking interval.

18. The display device of claim 13, wherein the power control signal is a pulse-width modulated power control signal to control the power supply.

19. The display device of claim 18, wherein the timing controller is configured to vary a duty cycle of the pulse-width modulated power control signal at least twice to sequentially generate a first pulse-width modulation signal and a second pulse-width modulation signal during one frame period, and wherein the power supply is configured to vary the level of the supply voltage during the blanking interval only when a duty cycle of the first pulse-width modulation signal and a duty cycle of the second pulse-width modulation signal are substantially equal to each other, wherein the power supply comprises:

a duty cycle calculator configured to calculate the respective duty cycles of the first and the second pulse-width modulation signals;

a voltage variation decision circuit configured to compare the duty cycle of the first pulse-width modulation signal and the duty cycle of the second pulse-width modulation signal, and to output an enable signal if the duty cycle of the first pulse-width modulation signal and the duty cycle of the second pulse-width modulation signal are substantially equal to each other; and a voltage variation circuit configured to vary the level of the supply voltage based on the vertical synchronization signal, the duty cycle of the first or the second pulse-width modulation signal, the enable signal, and a previous level of the supply voltage.

20. The display device of claim 13, further comprising a sensor circuit configured to sense an environmental condition of the display device and to provide a sensing data to the timing controller, wherein the level of the supply voltage is configured to be varied based on the sensing data.

21. The display device of claim 13, wherein the power supply is configured to vary the level of the supply voltage during the blanking interval based on the counter value received during one or both of another image display period directly preceding the blanking interval and another blanking interval directly preceding the another image display period, the display panel being configured to display an image during the image display period and to display no image during the blanking interval.

22. The display device of claim 13, wherein the timing controller is configured to generate the power control signal to the power supply based on a Single Wire Protocol.

* * * * *